United States Patent [19]

Thompson

[11] 4,337,876

[45] Jul. 6, 1982

[54] APPARATUS FOR DISPENSING ARTICLES

[75] Inventor: Joseph Thompson, Bergen County, N.J.

[73] Assignee: Sterling Drug Inc., New York, N.Y.

[21] Appl. No.: 168,140

[22] Filed: Jul. 14, 1980

Related U.S. Application Data

[63] Continuation-in-part of Ser. No. 68,967, Aug. 23, 1979, abandoned.

[51] Int. Cl.[3] ..... A47K 10/20

[52] U.S. Cl. ..... 221/36

[58] Field of Search ..... 222/543, 529, 530; 221/63, 50, 47, 36; 206/205, 206; 215/227, 231, 305; 220/375

[56] References Cited

U.S. PATENT DOCUMENTS 3,095,991 7/1963 Paniagua .
3,255,910 6/1966 Winston .
3,419,198 12/1968 Pettersen .
3,749,296 7/1973 Harrison .
3,765,574 10/1973 Urquiza .
3,998,354 12/1976 Song ..... 222/541 X
4,017,002 4/1977 Doyle et al. ..... 221/63
4,066,190 1/1978 Chlystun ..... 222/529
4,101,026 7/1978 Bonk .

FOREIGN PATENT DOCUMENTS 1177336 1/1970 United Kingdom .

*Primary Examiner*—Stanley H. Tollberg
*Attorney, Agent, or Firm*—Wenderoth, Lind & Ponack

[57] ABSTRACT

A dispensing device for towels and like articles comprises a container having a removal closure with a slitted opening and a cap integral therewith for closing the slitted opening, and includes a threading protrusion integral with the cap for receipt through the slitted opening whereby a towel may be engaged therewith and drawn from the container through the slitted opening to initiate dispensing of towels through the slitted opening.

13 Claims, 7 Drawing Figures

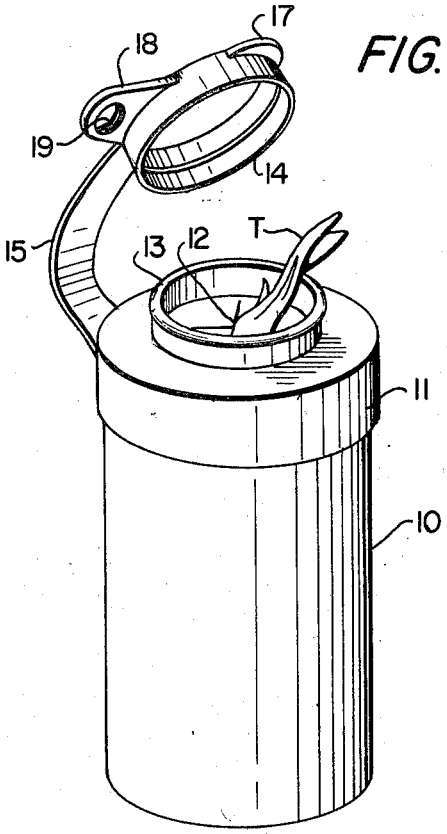
FIG. 1
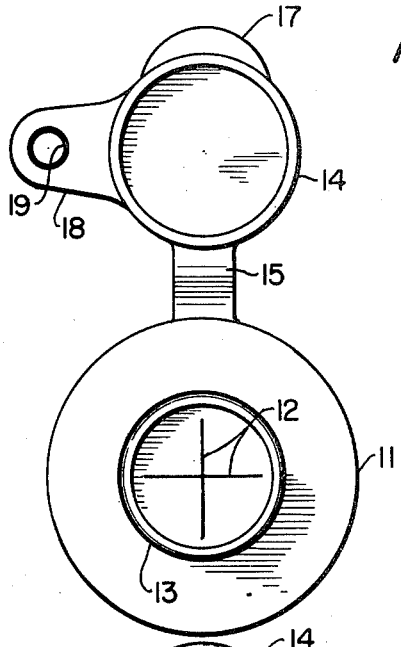
FIG. 2
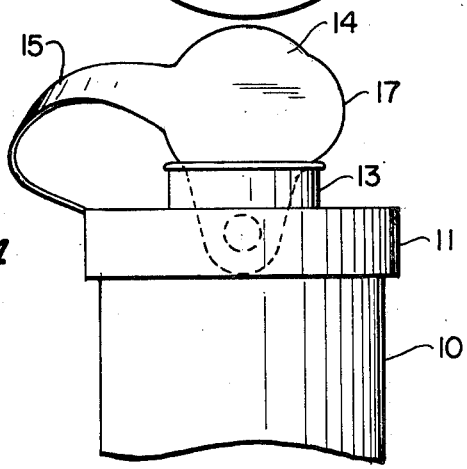
FIG. 4
FIG. 3
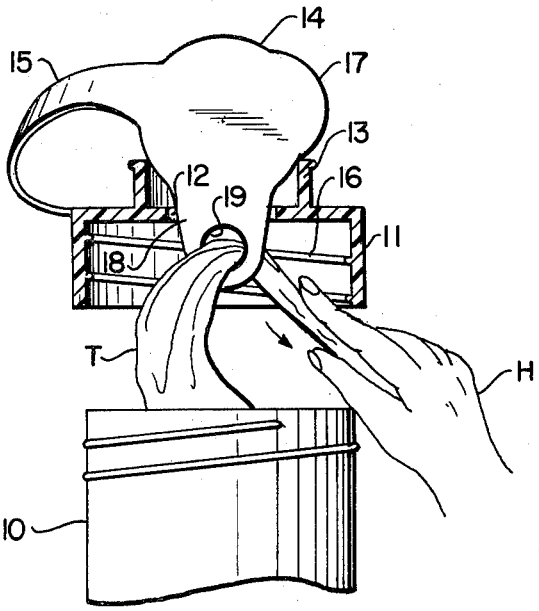
FIG. 5
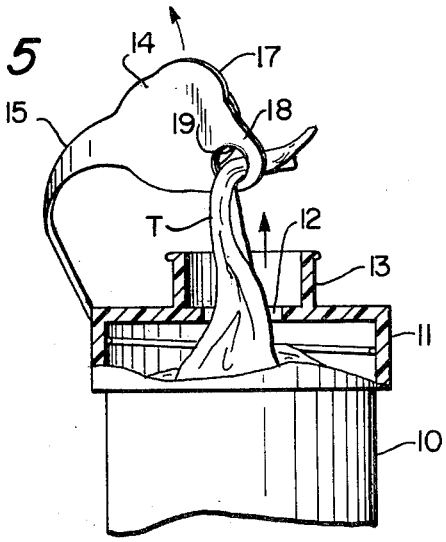

APPARATUS FOR DISPENSING ARTICLES

This is a continuation-in-part of Serial No. 68,967, filed Aug. 23, 1979, now abandoned.

BACKGROUND OF THE INVENTION

This invention relates to a dispensing device for dispensing articles, and more particularly, to a dispenser for premoistened towels or tissues, wherein the dispenser has a removable closure with a slitted opening therethrough through which the towels or tissues and the like are removed one at a time.

The slitted opening, as contemplated herein, encompasses narrow slots where the sides of the opening are not in contact with each other as well as those where the sides are in contact with each other but can be displaced to define the opening. The essential requirement is that the opening be too narrow to permit convenient withdrawal of the contents of the container by merely inserting one's fingers therein.

An example of a prior art dispenser of the type with which this invention is concerned is disclosed in U.S. Pat. No. 4,017,002. In order to initiate threading of towels through the slitted opening in the dispenser described in this patent, it is necessary for the user to push a leading part of a towel through the slitted opening, e.g., with a finger, so that it may be grasped from outside the container to thereafter draw the towel from the container through the slitted opening, The towels are arranged in the container such that withdrawal of one towel causes threading of a subsequent towel through the slitted opening so that it may be grasped.

Another type of dispenser is described in U.S. Pat. No. 4,101,026, in which a threading implement or device 6 is used for withdrawing an initial towel from the container. However, in this patent, the threading device or implement is separate from the container and after its initial use may become lost or misplaced.

In a dispensing device currently on sale, the closure cap has a finger tab integral therewith, which could, in theory, be employed as a threading device to initiate dispensing. However, the finger tab of this device, which contains an aperture in the mid-portion thereof, is of a size, rigidity and alignment such that it would be highly impractical to employ it in this manner.

SUMMARY OF THE INVENTION

Accordingly, it is a principal object of the invention to provide a means associated with a dispenser having a slitted opening therein, which may be extended through the slitted opening to facilitate threading of towels therethrough.

Another object of the invention is to provide a threading device integral with the closure cap of a container for dispensing towels or tissues and the like whereby the threading device cannot be lost or misplaced and is always associated with the container for use to initiate threading of a towel or the like from the container.

BRIEF DESCRIPTION OF THE DRAWINGS

FIG. 1 is a top perspective view of a dispenser according to the invention.

FIG. 2 is a top plan view of a dispenser according to the invention showing the closure cap in open position.

FIG. 3 is a fragmentary exploded view in elevation and shown partly in section of the dispenser of the invention.

FIG. 4 is a fragmentary view in elevation of the dispenser of the invention showing the threading device inserted through the opening in the container closure.

FIG. 5 is a fragmentary view in elevation shown partly in section of a dispensing device according to the invention wherein the threading device or protrusion is withdrawn from the opening in the container closure for drawing a towel therethrough.

DETAILED DESCRIPTION OF THE PREFERRED EMBODIMENT

Figure 6A:
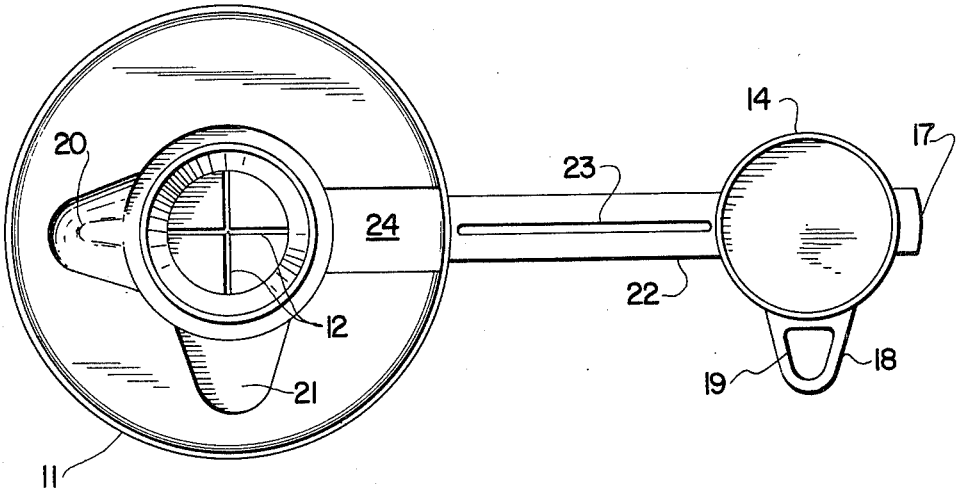
FIG. 6A is a top plan view of a preferred embodiment with the closure cap in the open position.
Figure 6B:
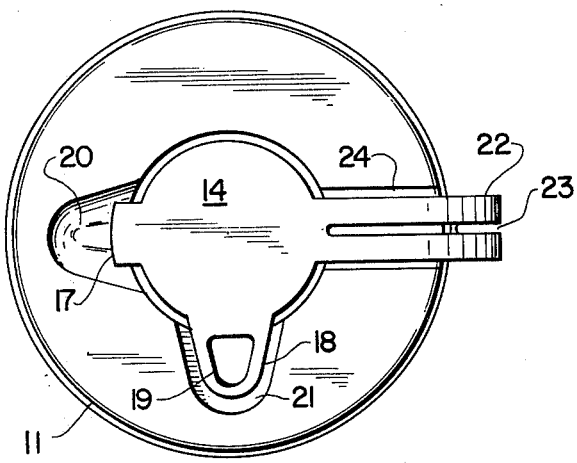
FIG. 6B is a top plan view of the closure of FIG. 6A, with its cap closed.

In the drawings, wherein like reference numerals indicate like parts throughout the several views, a container 10 has a removable closure 11 on one end thereof with a slitted opening 12 surrounded by an upstanding wall or rib 13 and a cap 14 for closing the opening 12 integrally joined therewith by means of a strap 15, as described in more detail in U.S. Pat. No. 4,017,002, for example. Of course, other means for securing the removable closure 11 to the container 10 could be provided, such as threads 16 shown in FIG. 3, for example. A finger engaging tab or flange 17 is formed on one side of the cap 14 to facilitate removal of the cap from the upstanding flange or neck 13 surrounding the slitted opening 12 for access to towels or tissues or the like T pulled through the slitted opening 12.

In order to facilitate threading of the towels or tissues and like through the slitted opening, a threading protrusion 18 having a hole or opening 19 formed therethrough is integral with the cap 14 on one side thereof. In use, the closure 11 is removed from the container 10 as seen in FIG. 3, for example, and the threading protrusion 18 on the cap 14 is inserted through the slitted opening 12 in the closure 11. One end of a towel or tissue or the like T is then grasped with the fingers of the hand H of a user and inserted through the opening 19 in the threading protrusion 18, and the closure 11 may then be placed back on the container 10 as seen in FIG. 4. Thereafter, the cap 14 is pulled upwardly, withdrawing the threading protrusion from the slitted opening before the closure is placed back on the container if desired. The end of the towel or tissue or the like is then removed from the opening 19 in the threading protrusion 18 and the dispensing container of the invention is ready for use. Subsequent towels are automatically threaded through the slitted opening in a manner well known in the art. However, in the event a towel fails to thread through the slitted opening, the above process can simply be repeated to once again initiate a dispensing cycle.

It is of course possible to vary the disposition axis of the protrusion with respect to the longitudinal axis of the strap, but the nearer these axes came to being aligned i.e. parallel, the more difficult it is to insert the protrusion 18 into slitted opening 12. Therefore, it is preferred that these axes be substantially transverse.

FIGS. 6A and B depict a preferred embodiment wherein cap 14 is recessed in closure 11 to facilitate stacking and prevent accidental opening. Recess 20 facilitates easy access to and provides a nest for finger engaging tab or flange 17 and recess 21 provides a nest for threading protrusion 18.

It is, of course, desirable that threading protrusion 18 be sufficiently rigid, narrow and thin to permit ready exit and entry into the slitted opening, i.e cross slits 12 and that the protrusion be laterally disposed i.e. in the same plane as the flexible strap.

It is also preferred that threading protrusion 18 be wedge-shaped and that the threader eye 19 be relatively small and tapered so as to hold the towelette or the like securely when it is pulled through the dispenser slits.

The provision of at least one slit parallel to the longitudinal axis of the flexible strap is also preferred.

The strap or hinge 22 preferably contains a slit 23 to function as a hanging device and this strap nests in recess 24.

By means of the present invention, all of the components are integrally formed with one another whereby there is little likelihood of the threading device becoming lost of separated from the dispensing container. Additionally, the structure provided by the present invention is exceptionally simple and economical and does not require any modification of the existing dispensing container other than the provision of the threading protrusion on the side of the cap 14 and suitable recesses in the closure, if desired.

The present invention is not limited to a dispensing device for pre-moistened towels or tissues and the like as specifically described herein, but could be applied to many other types of articles which are to be dispensed through openings which make it difficult for the user to initiate threading or feeding of the articles through the opening.

I claim:

1. A dispensing device for articles comprising a container having:

a removable closure with a slitted opening, a cap integrally joined to said closure by a strap, for closing said opening, and a threading protrusion integral with the cap for receipt through the opening whereby an article may be engaged therewith and drawn from the container through the opening to initiate dispensing of the articles through the opening, said protrusion being sufficiently rigid to facilitate passage through said slitted opening, said threading protrusion having an opening therethrough through which part of an article in the container is inserted when the protrusion is extended through the opening in the closure, so that withdrawal of the protrusion from the opening pulls a part of the article along with it, whereby the article may be engaged and pulled from the container through the opening and said protrusion being thin enough to readily enter the slitted opening.

2. The device according to claim 1, wherein the cap is integrally joined with the closure via a flexible strap.

3. The device according to claim 2 wherein the longitudinal axis of the flexible strap and the protrusion are laterally disposed, and said protrusion having no axis alignment with said flexible strap.

4. The device according to claim 3 wherein the longitudinal axis of said flexible strap and the axis of said threading protrusion are substantially transverse.

5. The device according to claim 2 wherein said strap has an elongated perforation about the midportion thereof to facilitate storage by hanging said container.

6. The device according to claim 2 wherein the top surface of said closure is substantially flat to facilitate storage by stacking of similar containers.

7. The device according to claim 6 wherein the top surface of said closure has indentations thereon for nesting said flexible strap and said cap therein.

8. The device according to claim 7 wherein the cap has a finger tab thereon aligned substantially parallel to said strap.

9. The device according to claim 8 wherein the top surface of said closure has an indentation thereon for the nesting of said finger tab.

10. The device according to claim 2 wherein said articles comprise moist towels arranged in said container so that the removal of one towel from the container initiates removal of a subsequent towel.

11. The device according to claim 1 or 4 wherein the threading protrusion is wedge-shaped.

12. The device according to claim 1 wherein the slitted opening comprises cross slits.

13. The device according to claims 1 or 2 wherein said slitted opening comprises at least one slit parallel to the longitudinal axis of said flexible strap.

* * * * *

UNITED STATES PATENT AND TRADEMARK OFFICE

CERTIFICATE OF CORRECTION

PATENT NO. : 4,337,876

DATED : July 6, 1982

INVENTOR(S) : Joseph Thompson

It is certified that error appears in the above-identified patent and that said Letters Patent are hereby corrected as shown below:

Column 4, claim 13, line 43, "... to claims 1 or 2 wherein" should read -- ... to claims 1 or 12 wherein --.

Signed and Sealed this

*Fifteenth* Day of *February 1983*

[SEAL]

*Attest:*

GERALD J. MOSSINGHOFF

*Attesting Officer*

*Commissioner of Patents and Trademarks*